United States Patent [19]

Yamashita et al.

[11] Patent Number: 4,993,697

[45] Date of Patent: Feb. 19, 1991

[54] COPY SHEET STACK APPARATUS

[75] Inventors: Hiroki Yamashita; Toshio Matsui; Keichi Kinoshita; Kazuhito Ozawa; Wataru Kurahashi; Katsuya Yasuda, all of Osaka, Japan

[73] Assignee: Minolta Camera Kaisha, Osaka, Japan

[21] Appl. No.: 311,060

[22] Filed: Feb. 16, 1989

[30] Foreign Application Priority Data

| | | | |
|---|---|---|---|
| Feb. 18, 1988 | [JP] | Japan | 63-35896 |
| Feb. 18, 1988 | [JP] | Japan | 63-35898 |
| Apr. 22, 1988 | [JP] | Japan | 63-99542 |

[51] Int. Cl.[5] ..... B42B 1/02

[52] U.S. Cl. ..... 270/53; 270/58

[58] Field of Search ..... 270/37, 53, 58; 271/3.1

[56] References Cited

U.S. PATENT DOCUMENTS

| | | | |
|---|---|---|---|
| 3,682,328 | 8/1972 | Turner et al. . | |
| 4,134,672 | 1/1979 | Burlew et al. . | |
| 4,295,733 | 10/1981 | Janssen et al. . | |
| 4,497,478 | 2/1985 | Rschenhofer | 270/53 |
| 4,564,185 | 1/1986 | Hamlin et al. . | |
| 4,592,651 | 6/1986 | Oikawa | 270/37 |
| 4,603,971 | 8/1986 | Kukucka | 270/53 |

FOREIGN PATENT DOCUMENTS

| | | | |
|---|---|---|---|
| 0099250 | 1/1984 | European Pat. Off. . | |
| 60-183461 | 9/1985 | Japan . | |
| 60-248563 | 12/1985 | Japan . | |
| 61-72569 | 4/1986 | Japan | 270/53 |
| 1119069 | 5/1987 | Japan | 270/53 |
| 269852 | 11/1987 | Japan | 270/53 |

*Primary Examiner*—John T. Kwon
*Assistant Examiner*—Therese M. Newholm
*Attorney, Agent, or Firm*—Burns, Doane, Swecker & Mathis

[57] ABSTRACT

A copy sheet stack apparatus stacks copy sheets discharged from an image-forming device and binds them be means of a staple. The apparatus comprises a first accommodating device for accommodating copy sheets discharged from the image-forming device, a staple device for binding by way of the staple the copy sheets accommodated into the first accommodating device, a second accommodating device disposed below the first accommodating device to accommodate a bundle of the copy sheets bound be means of the staple, a fall device for making the bundle of the copy sheets bound by way of the staple fall from the first accommodating device to accommodate into the second accommodating device by its own weight, and a guide device disposed between the first accommodating device and the second accommodating device to guide the bundle of the copy sheets fallen from the first accommodating device to the second accommodating device. The guide device has a curl device for curling each bundle of the copy sheets in a direction intersecting perpendicularly to a bundle discharging direction so as to make each bundle thereof get rigid to smooth discharge it.

12 Claims, 10 Drawing Sheets

80
50
80a
SE1
61
62
70a
64
91
SE2
65
67
70
71
99
95
86
85
18
60
63
70b
100
69
88
90
SE4
165
87
131a
120
166
SE3
138
136
SL1
151
130
156
75
157
150
131
300
301
110
302
136
158
131b
200A
g
140a
SL2
155
140
161
196
SE5
f
160
180
SE6
211
195
SE7
160a
210
190
215
216
h

COPY SHEET STACK APPARATUS

BACKGROUND OF THE INVENTION

The present invention generally relates to a copy sheet stack apparatus in which copy paper sheets discharged from an image-forming device such as copying apparatus are accommodated, stacked and bound by a stapler.

Commonly, as examples of a copy sheet stack apparatus for accommodating copy sheets, there have been proposed, for example, in Japanese Laid-open Patent Publication Nos. 59-43765 and 60-183461, an apparatus which is generally called as finisher and is constructed so that copy sheets are stacked onto a tray to be arranged and bound by means of a staple and thus are moved therefrom to a stack unit to be stacked and accommodated thereinto. Then, in these constructions, the apparatus include a movable member for moving bundles of the copy sheets to the stack unit. That is, the apparatus in 60-183461 includes a belt for driving to swing and rotate, the belt serving as the tray and the apparatus in 59-43765 includes a pinch roller and a discharging roller, each member being driven for rotation thereof.

In the above apparatus, however, there have been some problems. That is, in the apparatus having the rollers, there has been such a problem that since the rollers are disposed to be capable of advancing and retreating so as to be driven only when the copy sheets are discharged, the apparatus is complex in mechanism. In the apparatus having the belt, there has been such a problems that since the belt is disposed to be capable of swinging, the apparatus is complex in mechanism and is required to form a very large dead space for swinging the belt.

Meanwhile, there has been proposed another kind of apparatus to be simple in mechanism in which each bundle of the copy sheets is fallen by its own weight from the tray while sliding. However, in the another apparatus, it is because each copy sheet passed through a fixing device intends to curl that it is difficult to make the copy sheets arrange and stack into the stack unit only by free falling of the copy sheets.

SUMMARY OF THE INVENTION

Accordingly, an essential object of the present invention is to provide a copy sheet stack apparatus in which a bound bundle of copy sheets discharged from a staple tray is capable of stacking into a stack unit through simple mechanism and well arranging to each other therein.

In accomplishing this and other objects, according to one preferred embodiment of the present invention, there is provided a copy sheet stack apparatus for stacking copy sheets discharged from an image-forming device and binding them by means of a staple comprising; first accommodating means for accommodating copy sheets discharged from the image-forming device, staple means for binding by means of the staple the copy sheets accommodated into said first accommodating means, second accommodating means disposed below said first accommodating means to accommodate a bundle of the copy sheets bound by means of the staple, fall means for making the bundle of the copy sheets bound by means of the staple fall from said first accommodating means to accommodate into said second accommodating means by its own weight, and guide means disposed between said first accommodating means and said second accommodating means to guide the bundle of the copy sheets fallen from said first accommodating means to said second accommodating means, said guide means having curl means for curling each bundle of the copy sheets in a direction intersecting perpendicularly to a bundle discharging direction so as to make each bundle thereof get rigid to discharge it.

By the arrangement according to the present invention, the sheets discharged from the image-forming device enter the first accommodating means and are bound by the staple means to form a bundle. Then, on the basis of driving of the fall means, the bundle of the sheets falls by its own weight to be accommodated into the second accommodating means. In accommodating operation of the bundle, the bundle of the sheets is guided by the guide means and is curled in the direction intersecting perpendicularly to the bundle discharging direction by the curl means so as to get the bundle rigid. Then, discharge and arrangement of the bundle thereof into the second accommodating means can be improved.

In another aspect of the present invention, the copy sheet stack apparatus for stacking copy sheets discharged from an image-forming device and binding them by means of a staple comprising; copy sheet holding means for holding the copy sheets discharged from the image-forming device in condition where each sheet stands, said holding means having a copy sheet regulating member for regulating a lower end of each sheet to hold the sheet thereon so as to be capable of moving between a first position where the regulating member contacts with and holds the sheet and a second position where the regulating member withdraws from the sheet not to hold with it, staple means for binding by means of the staple a bundle of the sheets held by said copy sheet holding means, moving means for driving to move the regulating member from the first position to the second position, and a projecting member extending from the second position towards the first position to intersect the regulating member to contact with a surface of the sheet so as to free from regulating the lower end of the sheet and fall the bundle of the sheets bound by means of the staple while the regulating member moves from the first position to the second position.

By the arrangement according to the present invention, the sheets discharged from the image-forming device enter the holding means to be regulated by the regulating member not to fall and are bound by the staple means to form a bundle. Then, on the basis of driving of the moving means, the regulating member moves from the first position to the second position and the projecting member intersects the moving means to contact with the surface of the sheet so that the bundle of the sheets falls by its own weight.

Therefore, according to the present invention, since when the bundle of the sheets falls on the basis of driving of the moving means, the regulating member intersects the moving means to contact with the sheets and the bundle thereof is regulated by the regulating member to smoothly fall by its own weight, the bundle of the copy sheets can be smoothly discharged from the holding means through simple mechanism. Furthermore, the apparatus can prevent a lower of the bundle thereof from catching by the regulating member and from being smoothly and completely discharged.

In a further aspect of the present invention, the copy sheet stack apparatus for stacking copy sheets discharged from an image-forming device and binding them by means of a staple comprising a copy sheet accommodating tray for holding the sheets discharged from the image-forming device in condition where each sheet stands, the tray including; a base having a cutout extending from a lower end of the sheet accommodated thereonto to an upper end thereof, a plate member disposed in the cutout thereof to be capable of swinging between a first position and a second position, said plate member closing a bottom of said tray at the first position and opening the bottom thereof at the second position, staple means for binding by means of the staple the sheets accommodated into said tray, and fall means for swinging said plate member from the first position to the second position to fall the sheets bound by means of the staple in said tray.

By the arrangement according to the present invention, since when the plate member is positioned at the first position, the plate member closes the bottom of the tray, the bundle of the sheets is accommodated into the tray. Since when the plate member moves from the first position to the second position on the basis of driving of the fall means, the plate member opens the bottom of the tray, the bundle of the sheets falls. Therefore, the bundle of the copy sheets can be smoothly discharged from the tray through simple mechanism. Furthermore, the apparatus can prevent a lower of the bundle thereof from catching by the regulating member and from being smoothly and completely discharged.

In still another aspect of the present invention, the copy sheet stack apparatus in which after plural copy sheets discharged from an image-forming device are bound by means of a staple to form a bundle, the bundle of the sheets are stacked into a bucket, the apparatus comprising guide means for guiding the sheets into the bucket while the sheets fall by their own weight, the bucket having a front wall for making the sheets fall to contact with each sheet at a front end thereof and enter the bucket, an upper end of the front wall thereof being disposed below a copy sheet discharging end of the guide means so that after a specified amount of bundles of the sheets are accommodated into the bucket, the following bundle of the sheets passes over the bundle of the sheets accommodated thereinto to an outside of the bucket.

By the arrangement according to the present invention, the copy sheets discharged from the image-forming device are bound by means of the staple. Then, on the basis of guide of the guide means, the bundle of the sheets falls by its own weight to be accommodated into the bucket. In the bucket, a front end of the bundle of the sheets contacts with the front wall of the bucket to fall and stack into the bucket. If the specified amount of bundles of the sheets are accommodated into the bucket, it is because the upper end of the front wall thereof is disposed below the copy sheet discharging end of the guide means that the following bundle of the sheets passes over the bundle of the sheets accommodated thereinto to an outside of the bucket. Therefore, the apparatus is simple and reliable in mechanism and can be produced at lower cost. It can be constructed so that the bundles are stably accommodated into the bucket to easily take out therefrom. Furthermore, the apparatus can prevent the bundles from jamming after the specified amount of the bundles are accommodated thereinto, and execute necessary copy operation to efficiently form an image on the copy sheets.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
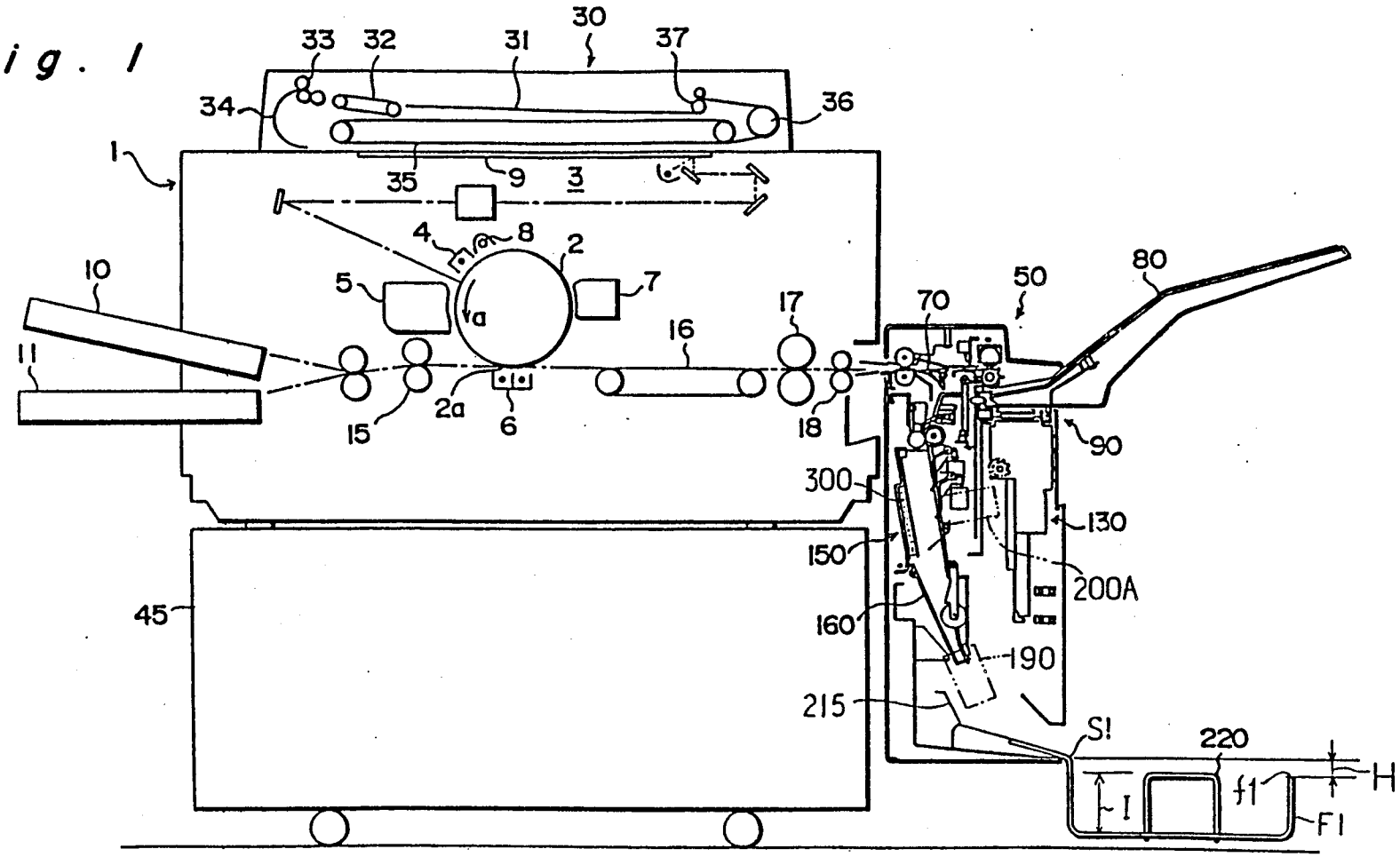
FIG. 1 is a schematically cross-sectional view of a copy apparatus and a finisher unit (a copy sheet stack apparatus) attached thereto according to one preferred embodiment of the present invention.

Before the description of the present invention proceeds, it is to be noted that like parts are designated by like reference numerals and symbols throughout the accompanying drawings.

FIG. 1 shows an example of a copy apparatus as image-forming device with a copy sheet stack apparatus 50, which is referred to as finisher unit hereinafter, according to one preferred embodiment of the present invention.

A copy apparatus body 1 as shown in FIG. 1 is mounted on a desk 45 and a recirculating automatic document feeder 30, which is referred to as RDH hereinafter, is attached on the upper surface of the body 1. In the body 1, a photosensitive drum 2 is disposed for driving to rotate in a direction indicated by an arrow a in FIG. 1, and various processing stations such as an optical system 3, a corona charger 4, a developing device 5, a transfer charger 6, a cleaning device 7, an eraser lamp 8, etc. are disposed around the photosensitive drum 2. Since the constructions and copy operation of these devices are well-known, the detailed descriptions thereof will be omitted.

Sheets of copy paper are accommodated into automatic feeding cassettes 10 and 11 and each one sheet of copy paper is selectively fed from the cassettes 10 and 11 to be transferred to a transfer unit 2a while being synchronized by a pair of timing rollers 15 and 15 with a toner image formed onto the outer circumferential surface of the photosensitive drum 2. After the transfer image is transferred to the copy paper, the copy paper is transported into a fixing device 17 through a transport belt 16 so that the toner on the copy paper is fixed to the paper. Then, the paper is discharged therefrom.

Figure 2:
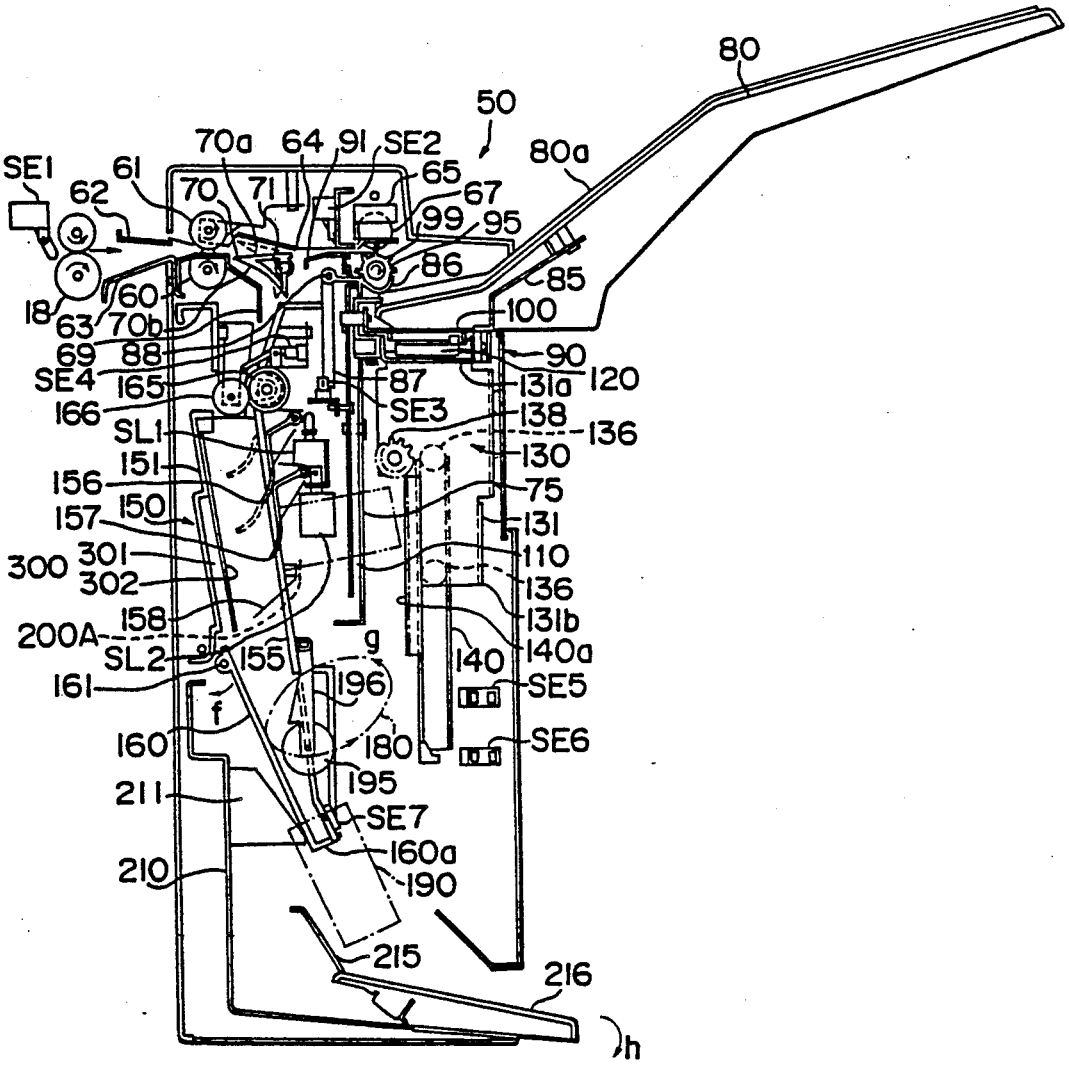
FIG. 2 is a schematically cross-sectional view of the finisher unit in FIG. 1, showing a modification of a guide unit for guiding copy sheets to a bucket.

In this process, the paper is detected by a sensor SE1 disposed in the upstream of a pair of discharging rollers 18, as shown in FIG. 2.

The RDH 30 generally includes a document placing tray 31, a document feeding belt 32, a pair of document feeding rollers 33, a reversal guide plate 34, a transport belt 35, a reversal roller 36 and a pair of discharging rollers 37. A last page of an original document placed on the tray 31 is always transported by RDH 30 in sequence. The original document is placed in such a manner that the back of each document sheet positions downward than the face thereof. On the basis of rotation of the document feeding belt 32, the last page of the document is pulled out from the document on the tray 31 and transported into a gap formed between the transport belt 35 and an original document platform 9 through the pair of document feeding rollers 33 and the reversal guide plate 34. Subsequently, the document is set at a specified position on the document platform 9 by rotation of the transport belt 35. Then, the document is exposed by an optical system (not shown). After the exposure of the original document image, the document is transported by the transport belt 35 from the position on the platform 9 in a rightward direction in FIG. 1. Thus, it is discharged from the pair of discharging rollers 37 to an initial position on the document placed on the tray 31 through the reversal roller 36 in such a manner that the face of the document positions upward.

The number of the document sheets and the number of copy paper sheets to be copied are capable of inputting by inputting means (ten keys) on an operation panel (not shown). After copy operation of a group of document finishes, as described hereinafter, the copy operation is interrupted for executing a shift process of a discharge tray 80 or both of a staple process and a stamp process and a group of document corresponding to a specified number of copy paper sheets inputted by the ten keys are circularly transported in above described manner.

The finisher unit 50 is constructed so that the copy paper discharged from the copy apparatus body 1 is selectively accommodated onto the discharging tray 80 or accommodated into the staple tray 150 to be arranged each other and to be bound to form a bundle of the copy paper by a stapler 190. Therefore, when a copy operation for obtaining the plural sheets of copy paper is executed through use of the RDH 30 while the staple process and the stamp process are simultaneously executed, the copy paper is accommodated into the staple tray 150 in sequence. Then, after a copy operation-finishing signal for indicating that all document on the copy apparatus body 1 is copied is generated and arrangement of the last page of copy paper finished, the stapler 190 and the stamper 200A are driven to bind and stamp the copy paper. The bound bundle of the copy paper is accommodated into a bucket or a stack bucket 220 to stack each other.

(Construction of the Finisher Unit)

The construction of the finisher unit 50 will be explained referring FIG. 2 etc.

The finisher unit 50 generally includes rollers 60 and 61 for receiving copy paper, a switching member 70 for selectively switching copy paper transport passes, the discharge tray 80, a shift block 90, an elevator block 130, the staple tray 150 with staple function and stamp function, the bucket 220 for accommodating and stacking the bound bundle of the copy paper discharged from the tray 150, and a guide plate 215. The shift block shifts the discharge tray 80 in a direction intersecting perpendicularly to a copy paper discharging direction each accommodation of copy paper corresponding to a group of the document. The elevator block 130 intermittently goes down the discharge tray 80 to generally keep a constant amount of copy paper when accommodated into the discharge tray 80. The guide plate 215 guides the bundle of the copy paper while the bundle of the copy paper falls from the tray 150 to the bucket 220 by its own weight.

A copy paper receiving unit of the copy apparatus includes the driving roller 60, the following roller 61, and guide plates 62 and 63 confronting the pair of discharging rollers 18. The finisher unit 50 further includes the switching member 70, guide plates 64, 69 and 91, and a sensor SE2 for detecting a copy paper discharging towards the discharging tray 80.

The switching member 70 is formed in a bill-like configuration and is attached to be capable of rotating around a supporting axis 71 serving as fulcrum. Thus, by turning-on of a solenoid (not shown), the member 70 is rotated from a position indicated by a solid line to another position indicated by a dotted line, as shown in FIG. 2. When the member 70 is located at the position indicated by the solid line, copy paper is guided towards the discharging tray 80 through the upper surface 70a of the member 70. When the member 70 is located at the position indicated by the dotted line, copy paper is guided towards the staple tray 150 through the curved surface 70b of the member 70.

Figure 3:
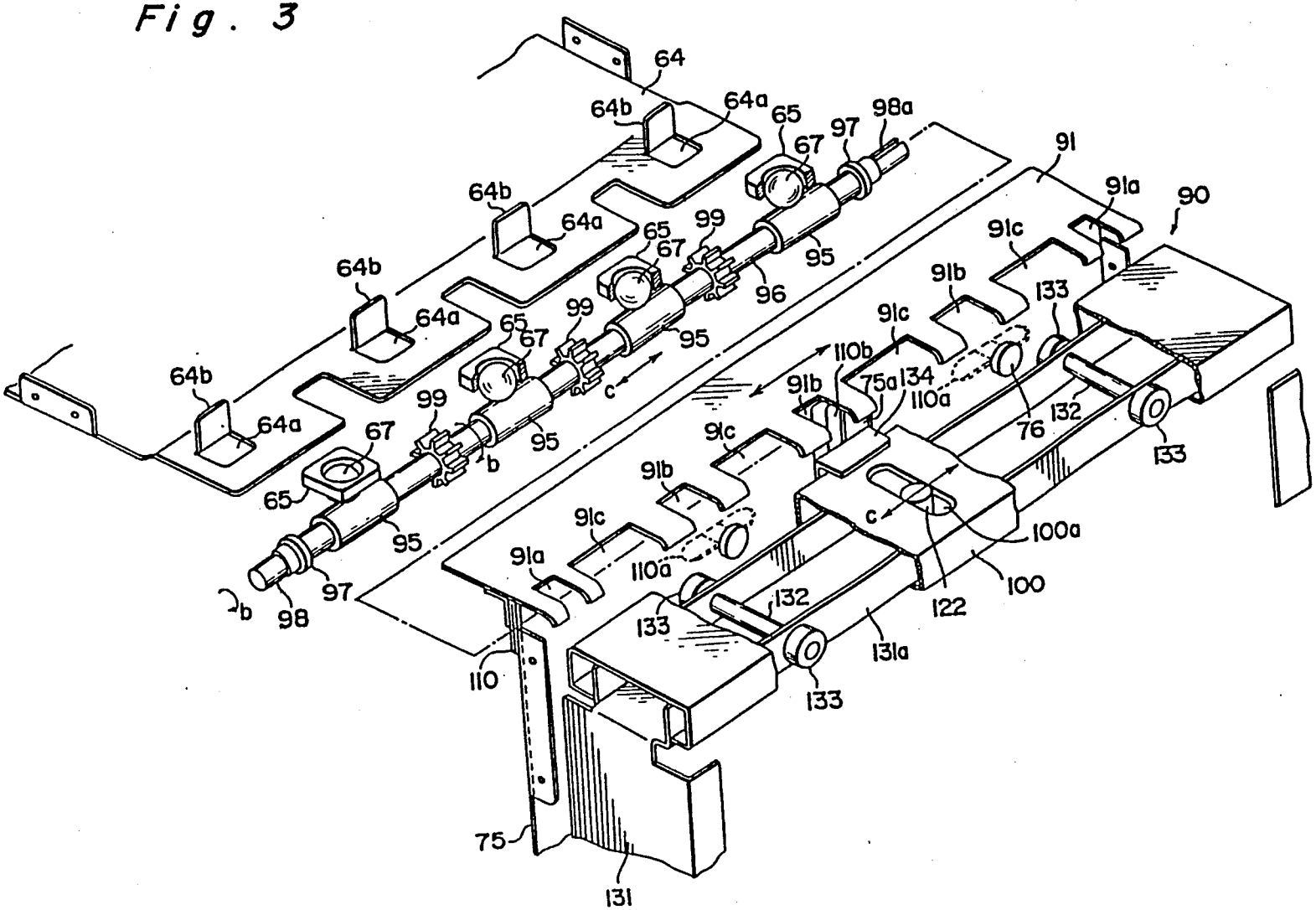
FIG. 3 is an exploded perspective view of a discharging roller and a shift block.

As shown in FIG. 3, each copy paper is discharged towards the discharging tray 80 by the discharging rollers 95 and balls 67, and the discharged copy paper is arranged by paddles 99 attached coaxially with the discharging roller 95. Each paddle 99 has a cylindrical body and flexible vane members radially attached at the body. On the basis of rotation of the paddles 99 in a direction indicated by an arrow b in FIG. 3, a bias force in the opposite direction to the copy paper discharging direction is applied to the back end of copy paper discharged onto the discharged tray 80 so as to contact the back end of the copy paper with fixed back plates 75 to arrange the copy paper.

In this unit, the discharging tray 80 shifts at a specified timing to group copy paper. Thus, the paddles 99 always contacts with the back end of the discharged copy paper, are preferably shifted so as to avoid confusion of the arrangement of the copy paper while interlocked with the shift operation of the discharging tray 80. Therefore, the paddles 99 and the discharging roller 95 are constructed so as to be capable of shifting together. That is, the paddles 99 and the discharging rollers 95 are fixed to a pipe-like axis 96 having a hole extending axially. A supporting axis 98 attached at a frame (not shown) to be capable of rotating is inserted into the hole of the axis 96 to engage therewith. The axis 98 is capable of rotating in the direction indicated by the arrow b in FIG. 3 by driving of a transport motor (not shown), and has a groove 98*a* at each end thereof. A projection (not shown) formed at a ling-like stopper 97 fixed to each end of the axis 96 is engaged into the groove 98*a* of the supporting axis 98. Therefore, the paddles 99 and the discharging rollers 95 are driven to rotate in the direction indicated by the arrow b together through the axis 96 on the basis of rotation of the supporting axis 98 and are capable of shifting in a direction indicated by an arrow c together. The shift operation is executed to be interlocked with such a shift operation that the stopper 97 is engaged into a cutout 91*a* of the lower guide plate 91 and that the lower guide plate 91 shifts in the direction indicated by the arrow c together with the shift block 90, as described hereinbelow. At that time, the paddles 99 and the discharging rollers 95 are positioned into the cutouts 91*b* and 91*c* of the lower guide plate 91, respectively.

Figure 4:
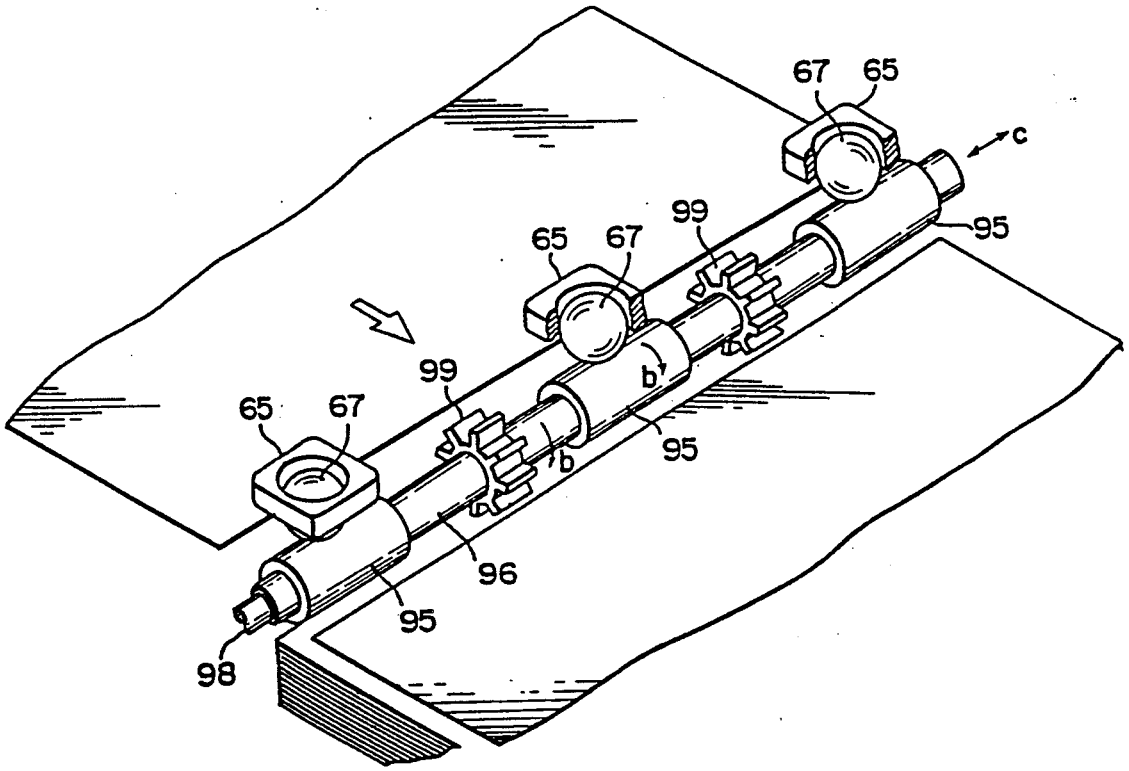
FIG. 4 is a perspective view for explaining discharge of the copy sheets to a discharging tray.

Meanwhile, each ball 67 contacts under pressure with the upper of each of the discharging rollers 95 by its own weight so as to be capable of rotating thereon. That is, as shown in FIGS. 3 and 4, each ball 67 is positioned at an opening 64*a* formed on the upper guide plate 64, and is prevented from moving by a holder 65 fixed to a cut protruding portion 64*b* raised from the opening 64*a*. The ball 67 in the holder 65 is capable of following to rotation and shift of the discharging roller 95, and transports the copy paper onto the discharging tray 80 while holding the copy paper with the discharging roller 95.

The discharging tray 80 has plural protruding portions 80*a* extending in the copy paper discharging direction at the upper surface thereof, as shown in FIG. 2 and is attached onto a shift frame 100 through a supporting plate 85. The back end of the discharging tray 80 extends above the upper of the fixed back plate 75, and an actuator 86 for actuating a sensor SE3 is positioned above the back end of the tray 80. The actuator 86 is integrally attached to an axis 88 with a lever 87 so as to be capable of rotating therewith, and the lower end of the lever 87 is normally blocked the passage of an optical axis of the sensor SE3. The number of copy paper sheets accommodated onto the discharging tray 80 increases and the actuator 86 is pushed up by the upper surface of the copy paper, the lever 87 rotates around the axis 88 serving as fulcrum in the counterclockwise direction shown in FIG. 2 with the actuator 86 so that the passage of the optical axis of the sensor SE3 is opened by the lower end of the lever 87. Thus, the sensor SE3 detects a level of the upper surface of the copy paper, so that the elevator block 130 described hereinbelow in detail is actuated so as to move down the discharging tray 80.

(Shift Block)

Figure 5:
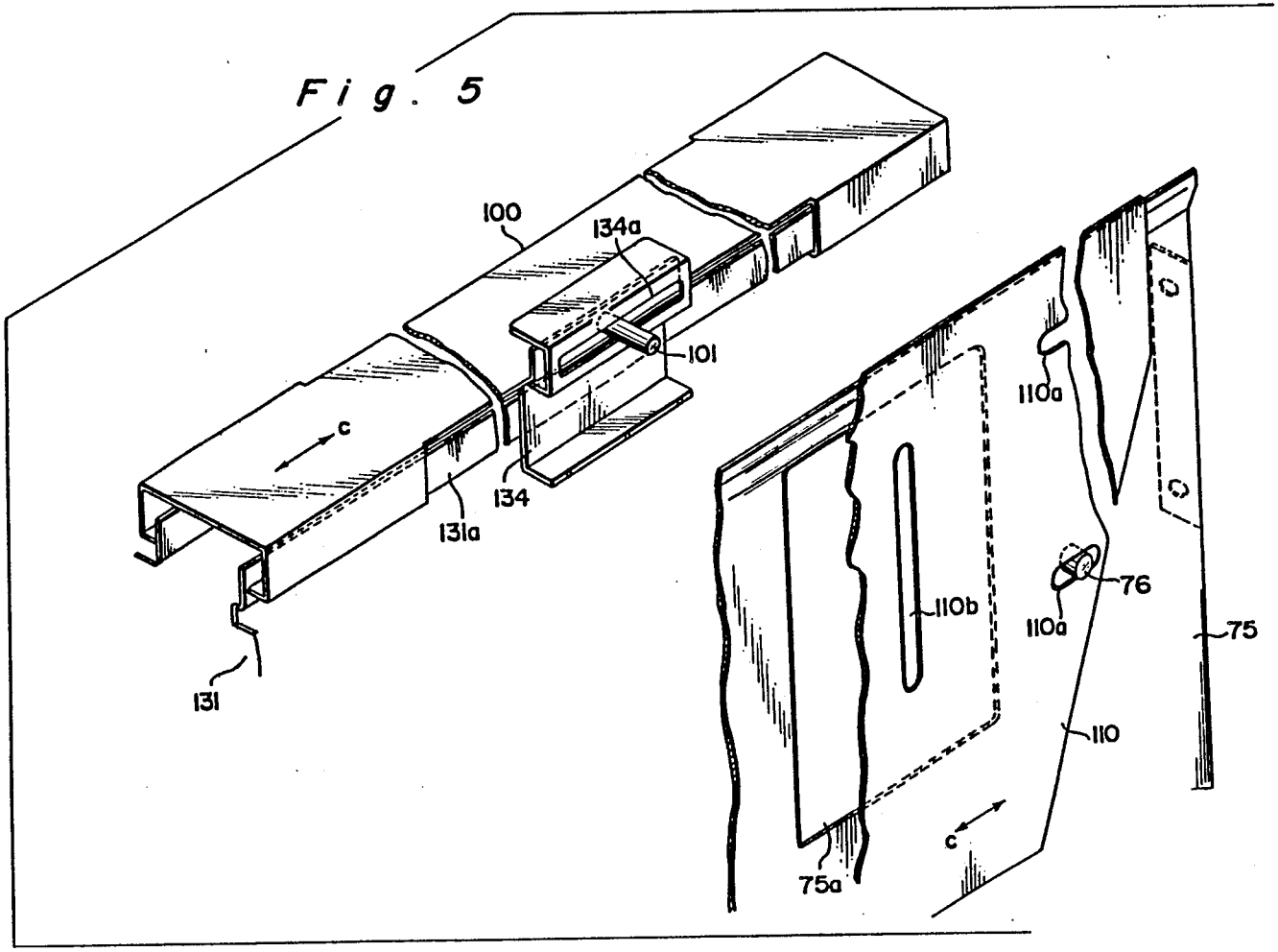
FIG. 5 is an exploded perspective view showing from the rear of the shift block.
Figure 7:
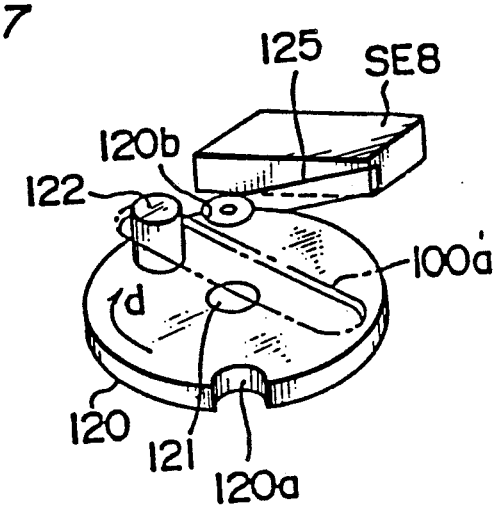
FIG. 7 is a perspective view of a cam for shift.

The shift frame 100 to which the discharging tray 80 is attached is capable of shifting in the direction indicated by the arrow c while guided by guide rollers 133 supported by a supporting axis 132 of a horizontal guide portion 131*a* of an elevator frame 131 so as to be capable of rotating around the axis 132, as shown in FIGS. 3 and 5. In the horizontal guide portion 131*a*, a cam 120 is disposed as shown in FIG. 7, and a pin 122 fixed at the peripheral of the upper surface of the cam 120 is engaged into a slot 100*a* of the shift frame 100. The cam 120 is driven to rotate around a supporting axis 121 serving as fulcrum in a direction indicated by an arrow d in FIG. 7 by driving of a shift motor (not shown). The cam 120 has recesses 120*a* and 120*b* each located at rotation symmetry positions at 180° intervals on the outer circumferential surface thereof. An actuator 125 of a sensor SE8 contacts with the outer circumferential surface of the cam 120 so that the sensor SE8 operates each engagement between the actuator 125 and the recesses 120*a* and 120*b* on the basis of rotation of the cam 120.

According to above construction, when a copy operation for copying the group of document finishes by use of the RDH 30 and the last sheet of the copy paper in correspondence to the last sheet of the document is accommodated onto the discharging tray 80, the shift motor (not shown) is turned on so that the cam 120 is driven to rotate in the direction indicated by the arrow d. Then, after the actuator 125 is engaged into one of the recesses 120*a* and 120*b*, the shift motor is turned off. That is, the cam 120 intermittently rotates 180° each time specified sheets of copy paper are accommodated onto the discharging tray 80, and the shift frame 100 repeats the reciprocating shift in the direction indicated by the arrow c, namely, a direction intersecting perpendicularly to the copy paper discharging direction with the discharging tray 80 through the pin 122.

Furthermore, the fixed back plate 75 and a movable back plate 110 are disposed at the back of the shift frame 100. The fixed back plate 75 is fixed to a body frame of the finisher unit 50 so as to regulate the back end of each copy paper accommodated onto the discharging tray 80. The movable back plate 110 is disposed so as to make the sensor SE3 and its actuator 86 shift while interlocked with the shift operation of the discharging tray 80, and the lower guide plate 91 is also fixed to the movable back plate 110.

Specifically, as shown in FIGS. 3 and 5, the movable back plate 110 is capable of shifting in the direction indicated by the arrow c on the basis of such a motion that three pins 76 fixed to the fixed back plate 75 are engaged into a slot 110*a* formed on the movable back plate 110. A pin 101 fixed to the shift frame 100 is engaged into both of a slot 134*a* of the guide plate 134 fixed to the horizontal guide portion 131*a* of the elevator frame 131 and a slot 110*b* formed on the movable back plate 110 in the longitudinal direction thereof through an opening 75*a* of the fixed back plate 75. Therefore, the movable back plate 110 shifts in the direction indicated by the arrow c with the shift frame 100 and the discharging tray 80 on the basis of engagement between the pin 101 and the slot 110*b*. Then, when the movable back plate 110 shifts, the plate 110 is guided on the basis of engagement between the lateral slot 110*a* and the pin 76. Meanwhile, according to motion of the elevator block 130 described hereinbelow in detail, when the shift frame 100 moves up and down with the discharging tray 80, since the pin 101 is guided into the slot 110*b*, the movable back plate 110 can hold at a position with a given height without moving up and down. That is, the discharging roller 95 and the actuator 86 can hold at each position with a given height.

(Elevator Block)

The elevator block 130 makes the discharging tray 80 move up and down while supporting the shift block 90.

Figure 6:
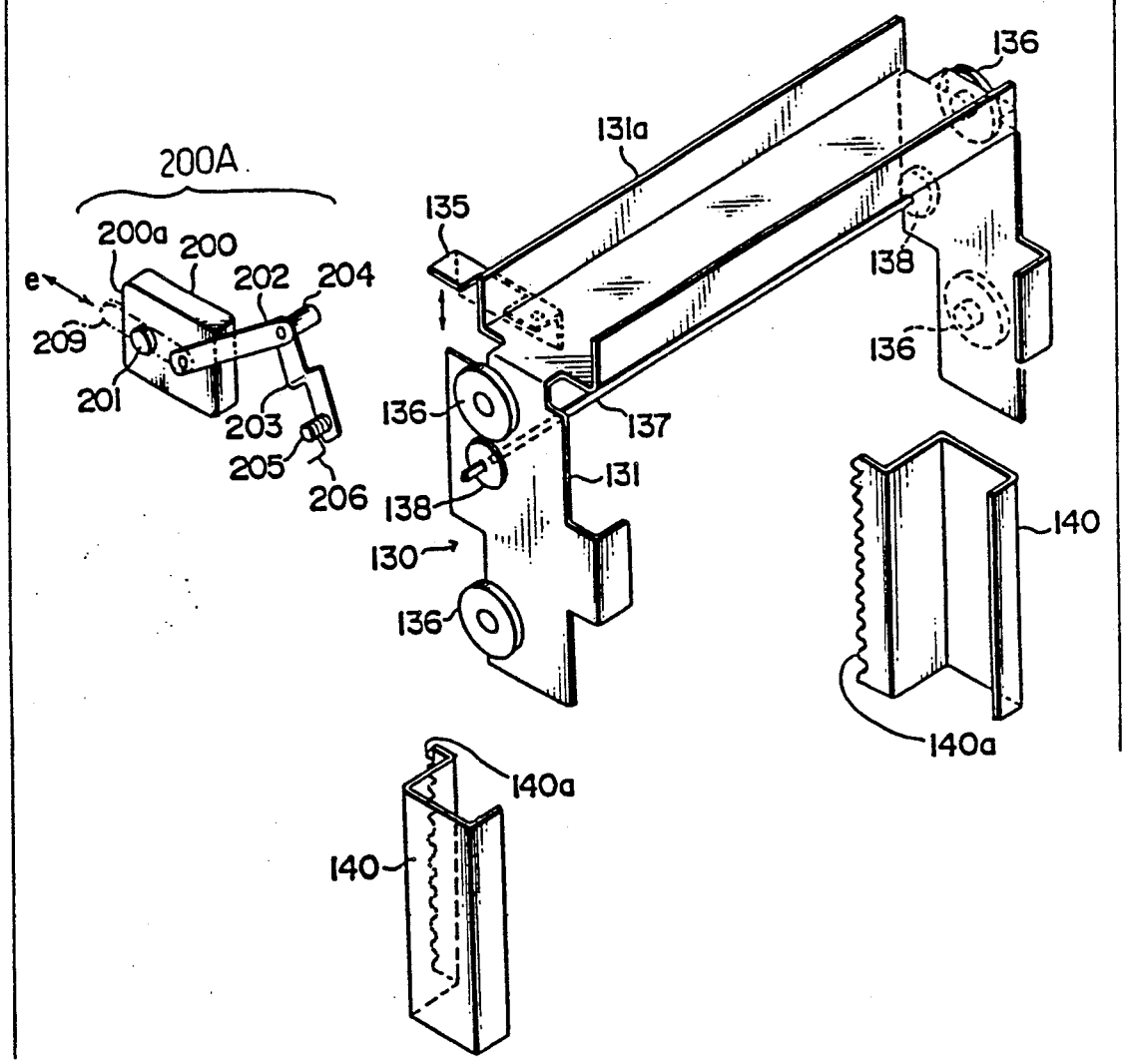
FIG. 6 is an exploded perspective view of an elevator block.

The elevator frame 131 for shiftably supporting the shift frame 100 is capable of moving up and down on the basis of such a motion that rollers 136 attached rotatably at each side of guide frames 140 are engaged inside the guide frame 140 fixed to a body frame (not shown) as shown in FIG. 6. Pinions 138 and 138 fixed a supporting axis 137 are attached to the elevator frame 131. Each pinion 138 is engaged with a rack 140*a* formed to each of the elevator guide frames 140 and 140, so that the pinions 138 and 138 are driven by a reversible elevator motor (not shown) capable of being driven for reversible rotation thereof, and the elevator frame 131 moves up and down with the shift frame 100 and the discharging tray 80 on the basis of rotation of the pinions 138 and 138.

According to above-described construction, when the number of the copy paper sheets discharged and accommodated onto the discharging tray 80 increases and the sensor SE3 operates by lifting the actuator 86 by the upper surface of the copy paper, the elevator motor is driven to rotate in one direction. Thus, the elevator frame 131 moves down with the shift frame 100 and the discharging tray 80. The upper surface of the copy paper did not push up the actuator 86 on the basis of the motion for moving down the discharging tray 80, the actuator 86 moves down, and thus the lever 87 blocks the passage of the optical axis of the sensor SE3 again. Then, rotation of the elevator motor in the one direction is stopped and thus the motion for moving down the elevator frame 131 etc. is stopped. In this manner, since the discharging tray 80 intermittently moves down in correspondence to an accommodating amount of the copy paper sheets, a height at which the back end of the copy paper falls on the discharging tray 80 automatically keeps less than a specified value. The value is the sum of a height from the nip portion between the discharging roller 95 and the ball 67 to a position detected the upper surface of the copy paper by the actuator 86 and a height at which the discharging tray 80 moves down during rotation of the elevator motor in the one direction. Then, coupled with the arrangement operation for arranging the copy paper by the paddles 99, the arrangement of the copy paper on the discharging tray 80 is improved.

Meanwhile, as shown in FIG. 2, a sensor SE5 and a sensor SE6 are disposed under the elevator block 130. The sensor SE5 and the sensor SE6 operates, respectively, on the basis of blocking each passage of the optical axes of the sensors SE5 and SE6 by the corner portion 131*b* of the elevator frame 131 moved down. The operation of the sensor SE5 means that a full of the copy paper is placed on the discharging tray 80. Then, an accommodation impossibility signal is inputted into the copy apparatus body 1 and, if necessary, a display for requiring to remove the copy paper from the discharging tray 80 is indicated on the copy apparatus.

Furthermore, the corner portion 131*b* of the elevator frame 131 moves down until the corner portion 131*b* is detected by the sensor SE6, so that the elevator frame 131 makes the stamper 200A operate.

(Stamp Function)

Hereinbelow, the stamp function will be explained.

Figure 9:
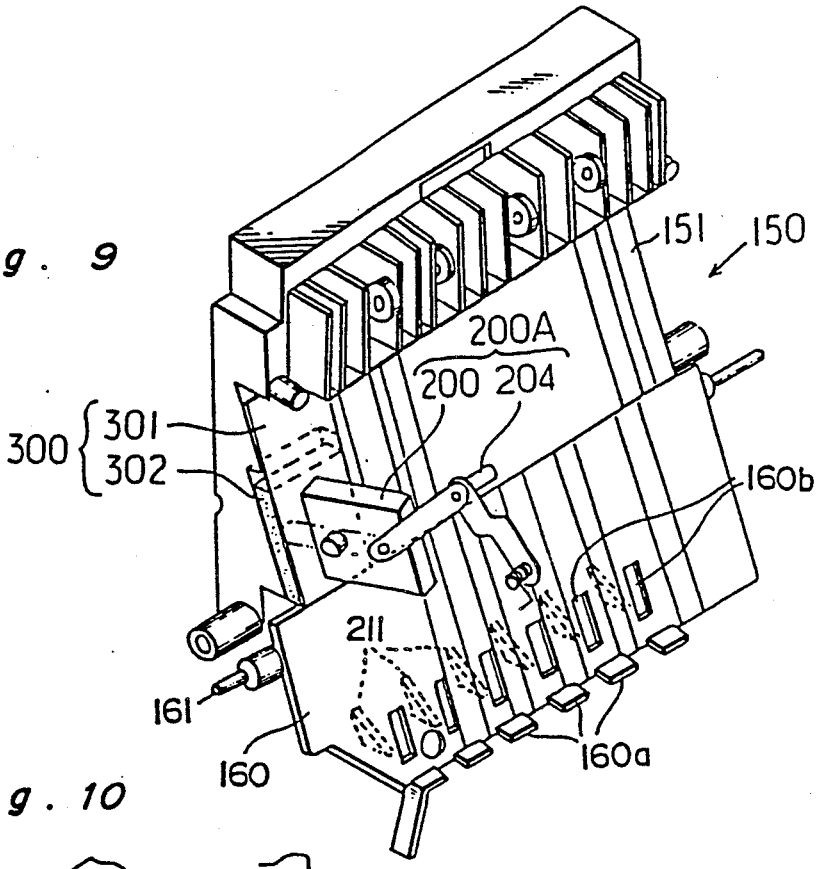
FIG. 9 is a perspective view of part of the staple tray and a stamper.

As shown in FIGS. 6 and 9, the stamper 200A takes such an action that a specified indication such as "confidential papers" or "please pass this on" etc. is stamped on the copy paper accommodated into the staple tray 150, as described below in detail. This stamper 200A is disposed so that it confronts a stamp pad 300 disposed at one side end, i.e. a standard side end for arranging the copy paper, of a base 151 of the staple tray 150 and is driven by the elevator frame 131. A stamp 200 constituting the stamper 200A is disposed so that a stamping surface 200*a* thereof is directed in a leftward direction in FIG. 6, and has a pin 201 movably in the direction indicated by the arrow e while guiding by a guide slot 209 of a frame (not shown). In the stamp 200, links 202 and 203 are coupled with each other by a pin 204. The link 203 is rotatably supported at a frame (not shown) by a pin 205 and is always urged upwardly by a torsion spring 206.

A protruding portion 135 is fixed to the horizontal guide portion 131*a* of the elevator frame 131, and the elevator frame 131 pushes the pin 204 to make the stamp 200 move in the direction indicated by the arrow e so that the stamp 200 stamps on the copy paper accommodated in the staple tray 150. This stamping operation is controlled to be executed right after staple operation by the stapler 190. Then, on the basis of the operation of the sensor SE6 as soon as the stamp 200 stamps, the elevator motor is driven to rotate in the opposite direction to the one direction so that the elevator frame 131 moves up to the original position. Then, the links 202 and 203 from which the pressure of the protruding portion 135 is removed rotate upwardly by the bias force of the torsion spring 206 so that the stamp 200 returns to the original position.

It is noted that the stamper is not limited in above-described construction alone, but, for example, other construction such as that the stamp is driven by a solenoid may be applied thereto.

(Staple Tray)

As shown in FIGS. 2 and 9, the staple tray 150 comprises the base 151, a guide plate 155 and a stopper 160 and is disposed to stand while slightly inclined to the vertical direction.

The stamp pad 300 confronting the stamp 200 is disposed at the one side of the base 151.

The stamp pad 300 is constructed so as not to be obstruct receiving of the copy paper into the tray 150, arranging it, and discharging it from the tray 150. That is, the pad 300 is made of soft elastic material with lower friction coefficient $\mu$ to the material of copy paper, and has a smooth surface at a height which generally agrees with the height of the surface of the tray so as not to protrude on the surface of the tray.

In the detail construction of the stamp pad 300, a soft sponge 302 made of polyester sheet 301 is affixed on the surface of the pad 300 in Figures.

It is noted that the stamp pad 300 is not limited in above-described construction alone, but, for example, the pad 300 may be made of other material such as silicone rubber, rubber affixed polyester sheet, or suitable soft material coated with lower friction coefficient coating, etc. That is, the material of the pad 300 has preferably such soft that the stamp 200 can clearly stamp on the copy paper without affecting slight inclination of the stamper 200A, curling of copy paper, thickness of copy paper, etc. Since the friction coefficient between the copy paper is about 0.3–0.7, commonly about 0.4, the friction coefficient $\mu$ between the surface of the pad 300 and the copy paper contacting with the pad 300 is preferably less than about 0.4, further preferably, about 0.3. The friction coefficient $\mu$ between the polyester sheet 301 and the copy paper in the embodiment is about 0.2–0.3.

The stopper 160 is rotatably supported by an axis 161 and coupled with a discharging solenoid (not shown) so as to regulate the lower of the copy paper accommodated into the staple tray 150. When the discharging solenoid is normally turned off, the stopper 160 is engaged with the lower of the guide plate 155 so as to close the bottom of the staple tray 150. When the discharging solenoid is turned on, the stopper 160 rotates around the axis 161 in a direction indicated by an arrow f so as to open the bottom of the staple tray 150.

Figure 8:
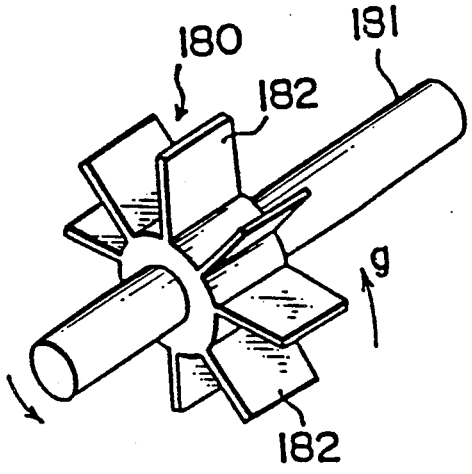
FIG. 8 is a perspective view of a paddle wheel in a staple tray.

A paddle wheel 180 for arranging the copy paper accommodated thereinto, the stapler 190 for binding the plural copy paper by a staple, a guide roller 195, and a sensor SE7 for detecting whether at least one sheet of the copy paper is into the tray 170 are disposed at the lower of the staple tray 150. The paddle wheel 180 has a cylindrical body into which a supporting axis 181 engages and plural soft vane members 182 attached radially to the outer surface of the body as shown in FIG. 8, and is driven to rotate in a direction indicated by an arrow g. By operation of this wheel 180, the vane members 182 contact with the copy paper, and thus the vane members 182 make one sheet of the copy paper transported into the staple tray 150 by its own weight fall to a lower end regulating portion 160*a* of the stopper 160 at a time. Then, the copy paper is urged in one direction so as to move to and contact with a side plate (not shown) for arranging the copy paper.

The stapler 190 is indicated by a virtual line in FIGS. 1 and 2 and is a known electrically powered member. In this embodiment, an electrically powered stapler produced by MAX CO., LTD as the stapler 190 is applied thereto. Since a pad for a staple is disposed on the same flat surface as the surface of the stopper 160, the corner of the bundle of the copy paper accommodated into the staple tray 150 and arranged is bound by means of the stapler. Other stapler may be applied as the stapler 190.

The guide roller 195 is attached rotatably t the lower of a lever 196 attached to the guide plate 155 to be capable of swinging so as to prevent the distal end of the bundle of the copy paper in accommodating and stacking from becoming bulky. The upper of the guide plate 155 extends to the vicinity of the switching member 70 so as to guide the copy paper to the staple tray 150 with the guide plate 69. Transport rollers 165 and 166 for transporting the copy paper into the staple tray 150, and a sensor SE4 for detecting the copy paper transported thereinto are disposed right above the staple tray 150.

Regulating levers 156 and 157 and a static eliminator brush 158 for eliminating static charge of the copy paper are disposed on the guide plate 155. On the basis of turning-on of solenoids SL1 and SL2, the regulating levers 156 and 157 are inserted into the staple tray 150 and are capable of rotating to positions indicated by dotted lines so as to regulate bending of the copy paper and to prevent the copy paper from being in disarray. Therefore, the regulating levers 156 and 157 are set to positions corresponding to a size of the copy paper capable of executing the staple process so as to regulate the upper end of the copy paper accommodated into the staple tray 150.

Subsequently, the construction for discharging the copy paper bound by the staple in the staple process from the discharging tray 80 will be explained.

In a frame 210 disposed in the finisher unit 150, a projecting portion 211 is attached to a position confronting the lower of the copy paper accommodated into the staple tray 150. The stopper 160 has a slot 160*b* in correspondence to the projecting portion 211 as shown in FIG. 9. Then, when, after the staple process, the stopper 160 rotates in the direction indicated by the arrow f so as to open the bottom of the staple tray 150, the projecting portion 211 projects through the slot 160*b* of the stopper 160 so as to regulate the lower of the copy paper. This is the reason that the above-described construction can prevent from causing a poor discharging operation which arises as a result of the following operation. That is, the lower of the copy paper moves in the direction indicated by the arrow f while the lower thereof contacts with the lower end regulating portion 160*a* of the stopper 160 in opening of the stopper 160, and thus the copy paper is not smoothly discharged. Therefore, the regulating surface of the projecting portion 211 is formed in such a inclined surface that the copy paper is guided in the copy paper discharging direction.

Figure 10:
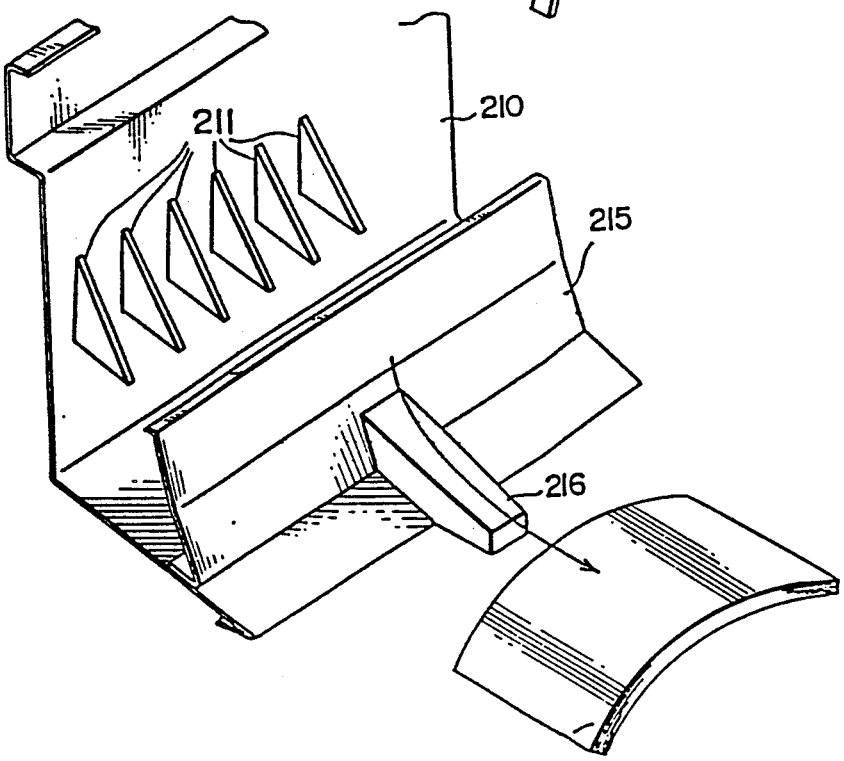
FIG. 10 is a perspective view showing a guide plate etc. in the case where a protruding portion is formed on the guide plate for guiding the copy sheets from the staple tray to a stack bucket.

The stapled copy paper is discharged into the bucket or the stack bucket 220 (see FIG. 1) while guiding by the guide plate 215 as shown in FIG. 10. At that time, each copy paper intends to easily curl in a direction indicated by an arrow h in FIG. 2 by heat applied from the fixing device 17 in the copy apparatus body. Then, since, in the case where the copy paper is guided by only the guide plate 215, there is a possibility that the copy paper is accommodated in disarray into the stack bucket 220, if desired, a protruding portion 216 are formed on the middle of the surface of the guide plate 215 as shown in FIGS. 2 and 10. Thus, each copy paper gets rigid to be smoothly discharged while it curls in a direction intersecting perpendicularly to the discharging direction, resulting of improvement of arranging it in the stack bucket 220.

(Bucket Unit)

Figure 11:
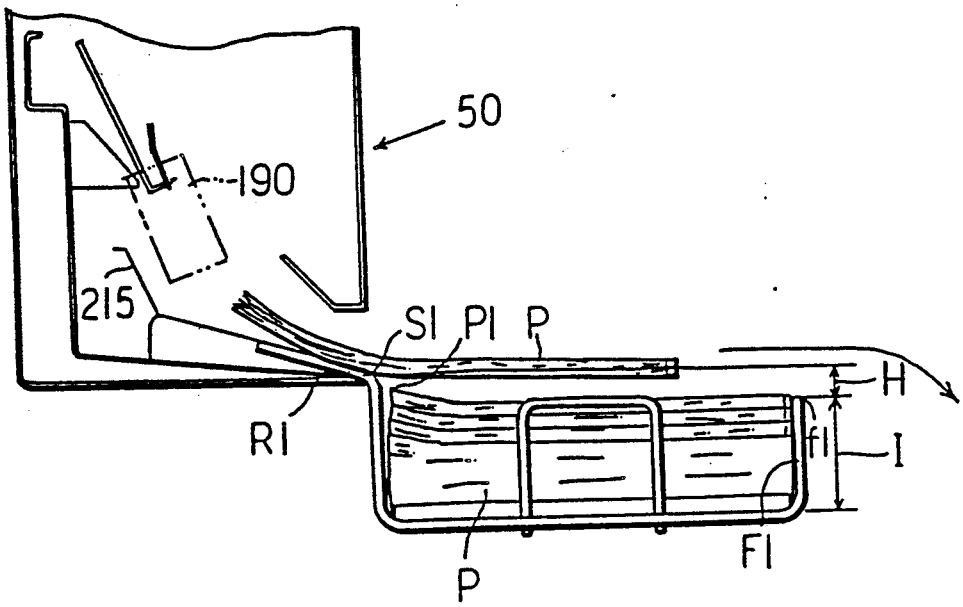
FIG. 11 is a view for explaining the use of the stack bucket shown in FIG. 1.

The rear wall R1 of the stack bucket 220 constituting the bucket unit extends below the guide plate 215 so that the stack bucket 220 is supported in cantilevered formation as shown in FIGS. 1 and 11.

The upper end f1 of the front wall F1 of the stack bucket 220 is disposed at a position only a distance H lower than a copy paper discharging end S1 of the guide plate 215.

The distance H is dimensioned so that when the bundles of the copy paper P are accommodated and stacked into the bucket 220 in full accommodation ability, the upper surface of the uppermost bundle of the copy paper P, namely, the rear end P1 curling upward and backward in FIG. 11, is located at the position lower than the discharging end S1 of the guide plate 215.

The depth I of the bucket 220 is dimensioned so that the bundle of the copy paper P putting into the bucket 220 while guiding by the guide plate 215 prevents from curling, is stably stacked in array into the bucket 220, and those bundles in the bucket 220 can be easily taken out therefrom later. In this embodiment, the depth I is about 60 mm.

According to the disposition of the stack bucket as above-described, each bundle of the copy paper P is put into the bucket 220 while transported rather downwardly from the guide plate 215, and collides with the front wall F1 of the bucket 220 to fall so as to be stacked thereinto. When the specified amount of the bundles of the copy paper are stacked into the bucket 220 which corresponds to the full accommodation ability of the bucket 220 in the embodiment, the following bundle of the copy paper passes over the upper surface of the uppermost bundle of the copy paper accommodated into the bucket 220 by fall energy of the following bundle of the copy paper fallen from the tray 150 to jump out and to fall outside the bucket 220. In this case, since the fallen distance of the bundle thereof is short, there is little possibility of damage of the bundle thereof but another bucket for accommodating the bundle of the copy paper can be preferably disposed near the bucket 220. Then, even if the bucket 220 is full of the bundles of the copy paper, since there is no possibility of collision and transport-stoppage of the bundle of the copy paper, the copy operation of the copy apparatus can be continued.

Figure 12:
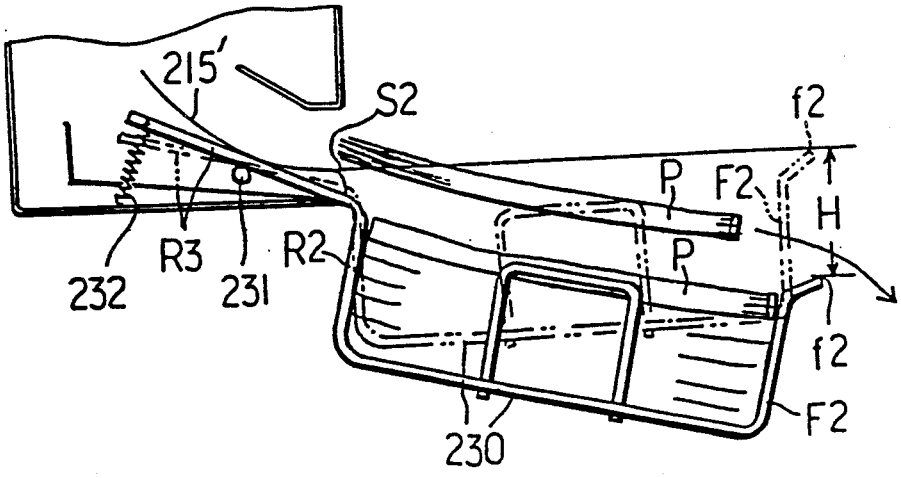
FIG. 12 is an explanatory view of a modification of the stack bucket shown in FIG. 11.

It is noted that a bucket 230 shown in FIG. 12 can apply thereto instead of the bucket 220. Though the bucket 230 has a bucket-like form, the upper end f2 of the front wall F2 of the bucket 230 is formed to outwardly incline. Firstly, the bucket 230 is located at a position shown by a virtual line and, at that time, the upper end f2 of the front wall F2 thereof is the same height as the discharging end S2 of the guide plate 215'. The portion R3 of the rear wall R2 extends below the guide plate 215' to put on a fulcrum member 231 and further extends so that the rear end thereof is supported by a spring 232 while connecting with a finisher unit frame by the spring 232. Then, the bucket 230 is supported in cantilevered formation.

When the bundle of the copy paper P is put into the bucket 230, the front end of the bundle thereof P collides with the front wall F2 of the bucket 230 and falls to be stacked into the bucket 230. As the bundle of the copy paper P is stacked thereinto, the bucket 230 rotates downwardly around the fulcrum member 231 against the bias force of the spring 232. When the bucket 230 is loaded to capacity with the bundles thereof as shown by a solid line in FIG. 12, the upper end f2 of the front wall F2 thereof is already positioned below the discharging end S2 of the guide plate 215'. Then, the following bundle of the copy paper P pass over the bucket 230 and jump out outside the bucket 230. Therefore, the copy operation of the copy apparatus can be continued.

As shown in FIGS. 2 and 10, when the projecting portion 216 is formed on the surface of the guide plate 215, the height of a copy paper discharging end of a guide unit constituted by these members is dimensioned to be the same as the copy paper discharging end of the guide plate 215 in the case where the projecting portion 216 is not formed thereon.

(Operating Mode)

The finisher unit 50 constituted as described above can operate in a non-staple mode, a staple mode and a staple and stamp mode.

The non-staple mode is an operating mode for accommodating and stacking the copy paper discharged from the copy apparatus body 1 onto the discharging tray 80. At that time, the switching member 70 is held at a position indicated by a solid line in FIG. 2, and the copy paper is discharged by the discharging roller 95 and the balls 67 onto the discharging tray 80 so as to be arranged on the basis of rotation of the paddles 99. Then, the elevator block 130 is operated as described above each time the sensor SE3 detects the upper surface of the copy paper accommodated thereonto, and a height of between the nip portion between the discharging roller 95 and the ball 67 and the upper surface of copy paper generally keeps a specified value.

The shift operation of the discharging tray 80 by the shift block 90 is automatically executed by such a set operation that the number of the copy paper sheet is set to more than 2 by manual control or a control of the RDH 30. Then, when one copy of the copy operation finishes and the sensor SE2 detects the discharge of the last sheet of the copy paper, the discharging tray 80 is laterally shifted, so that the copy paper sheets are grouped into each copy.

The staple mode is such an operating mode that the copy paper discharged from the copy apparatus body 1 is accommodated onto the staple tray 150, arranged by the paddle wheel 180, bound to form a bundle by operation of the stapler and the bound bundle thereof is accommodated into the stack bucket 220. At that time, the switching member 70 is set to a position indicated by the dotted line in FIG. 2, and the copy paper is transported into the staple tray 150 through the transport rollers 165 and 166 so as to be arranged on the basis of rotation of the paddle wheel 180. Then, after the arranging operation for arranging the last sheet of the copy paper corresponding to a group of the document to be copied finishes, the stapler 190 is driven to bind the bundle of the copy paper by a staple.

The stamp mode is such an operating mode that the specified indication is stamped by the stamper 200A on the first page of the bundle of the copy paper accommodated into the staple tray 150. As described above, in the embodiment, since the stamp mode can be executed with the staple mode, the stamp operation is executed right after the staple process. In this case, the elevator block 131 falls with the discharging tray 80 on the basis of operation of the elevator block 130 until the sensor SE6 detects the corner portion **131*b* of thereof. Thus, the stamp 200 is driven to move and stamp on the copy paper by linking operation between-the links 202 and 203. Then, the stamp pad 300** supports the back surface of the bundle of the copy paper to help to clearly stamp.

According to the finisher unit 50, it can get the following effects.

(1) Since the arranging, stapling and stamping operation of the copy paper can be executed at each place on one staple tray 150, a space for disposition of the members according to these operation becomes smaller as compared with the case where the finisher unit is constructed so that each operation separately executes or the case where it is constructed so that partial operation separately executes at each place.

(2) Since the stamp can be stamped on the copy paper under a condition where it is arranged and stood still on the tray 150, it can prevent the stamping position on the bundle from being shifted.

(3) Since the tray 150 has the stamp pad 300 made of soft elastic material, the indication can be clearly stamped on the copy paper without affecting installation error of the stamper 200A, curing of copy paper, copy paper accommodating capacity of the tray 150, etc., and such a great effect can especially obtain in the case where a small number of copy paper is copied.

(4) It is because, as a result of this point (3), it is not necessary to require high accuracy of the stamper that a unit of the stamper can be produced and installed at a lower cost.

(5) It is because the stamp pad 300 is made of material with lower friction coefficient and has a smooth surface at a height which generally agrees with the height of the surface of the tray that the receiving, arranging and discharging operation of the copy paper with respect to the tray 150 can be smoothly executed without obstacle.

(6) It is because the buckets 220 and 230 are not necessary to have an elevator device, a sensor etc. that the copy apparatus can be readily produced in simple and cheeper construction.

(7) Since the copy apparatus is constructed so that when a specified amount of the bundles of the copy paper are accommodated and stacked, the following bundle of the copy paper passes over the uppermost bundle of the copy paper accommodated into the bucket to move outside the bucket, it can prevent the bundle of the copy paper from jamming by collision of the bundle of the copy paper in the bucket unit, resulting in efficient execution of the copy operation and the staple operation.

(8) Since the buckets 220 and 230 each are shallow, the bundles thereof can be stably accommodated and stacked thereinto and can be easily taken out therefrom. Since the accommodation amount of the bundle thereof is small, a load for the finisher unit body in the case when the bucket is supported by the finisher unit becomes smaller and the copy apparatus looks like light weight as a whole.

Figure 13:
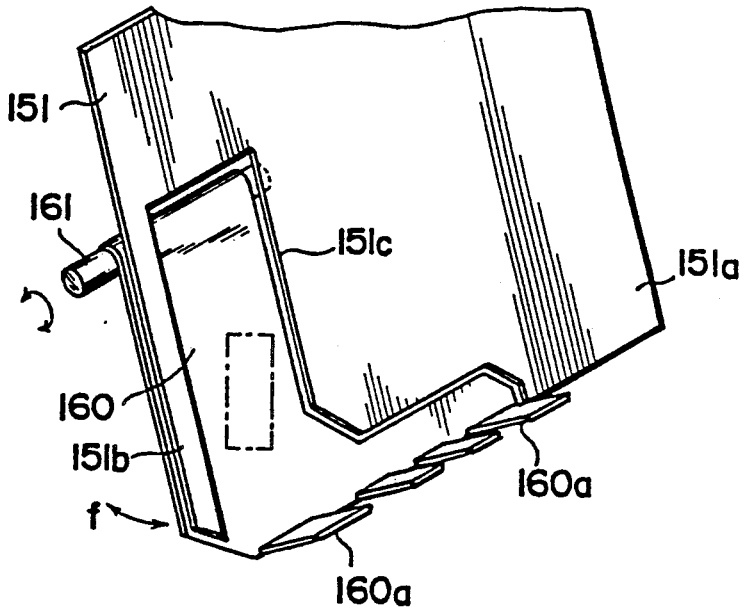
FIG. 13 is a perspective view of the lower of a staple tray according to a modification of the present invention.

FIG. 13 shows a main part of a modification of the present invention.

In this modification, the base 151 of the staple tray 150 extends to the lower of the tray and a cutout 151*c* is formed at an extending portion thereof excepting for a lower extending portions 151*a* and 151*b*. The stopper 160 is disposed on the almost same surface as the base 151 so as to close the cutout 151*c* of the base 151 and rotates around the supporting axis 161 as fulcrum in the direction indicated by the arrow f to open the lower of the staple tray 150 on the basis of turning-on of the discharging solenoid. A portion for connecting with the paddle wheel 180 is indicated by a dotted line in FIG. 13.

Each bundle of the copy paper accommodated, stacked and bound by the stapler 190 in the staple tray 150 slips on the base 151 by its own weight on the basis of rotation of the stopper 160 in the direction indicated by the arrow f, and thus accommodated into the stack bucket 220. At this time, the lower of the bundle thereof is regulated by the lower extending portions 151*a* and 151*b* of the base 151 instead of the projecting portion 211 of the above-described embodiment so as to prevent from causing such a situation that the bundle thereof is poorly or completely discharged because of catching by the lower end regulating portion 160*a* projected from the stopper 160.

Figure 14:
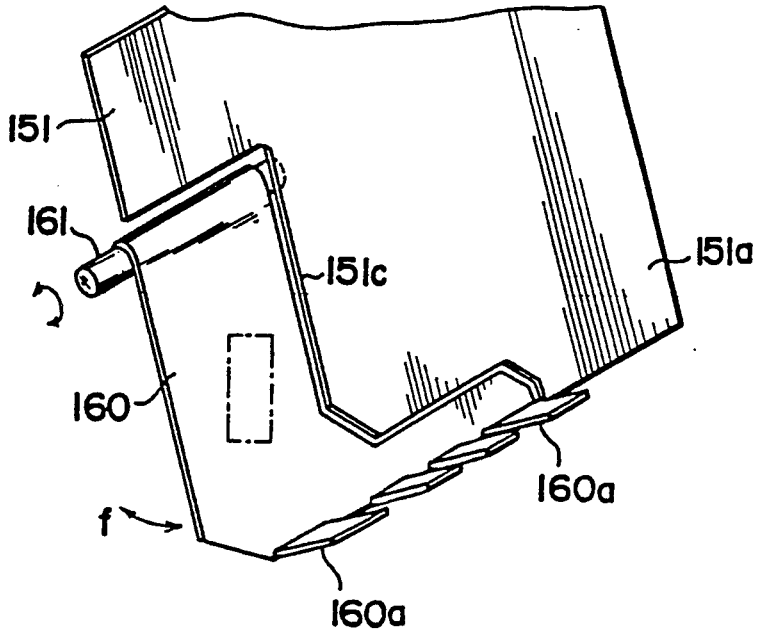
FIG. 14 is a perspective view of the lower of a staple tray according to a further modification of the present invention.

FIG. 14 shows a main part of further modification of the present invention.

This modification is constructed so that the lower extending portion 151*b* of the base 151 is removed therefrom and other construction is the same as the above modification shown in FIG. 13.

In the concrete construction of the staple tray 150, other construction may be applied thereto. In the stack unit, a box-like member may be applied thereto instead of the bucket described in the modification.

As is clear from the above description, the modification according to the present invention provides the apparatus in which the bundle of the copy paper can be smoothly discharged in spite of simple construction thereof and which can prevent from causing such a situation that the lower of the bundle thereof is caught by the stopper so as not to be smoothly and completely discharged, because the bundle thereof fallen by its own weight is regulated by the regulating member intersecting the stopper or the lower extending portion of the base as the lower of the staple tray is opened by the stopper.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A copy sheet stack apparatus for stacking copy sheets discharged from an image-forming device and binding them, comprising:

first accommodating means for accommodating copy sheets discharged from the image-forming device, binding means for binding the copy sheets accommodated in said first accommodating means, second accommodating means disposed below said first accommodating means to accommodate a bundle of the copy sheets bound by said binding means, fall means for making the bundle of the copy sheets bound by said binding means fall from said first accommodating means into said second accommodating means by its own weight, and guide means disposed between said first accommodating means and said second accommodating means to guide the bundle of the copy sheets falling from said first accommodating means to said second accommodating means, said guide means including curl means for curling each bundle of said copy sheets such that each bundle has a generally arcuate cross-section in a plane which is perpendicular to a bundle discharging direction so as to make each bundle thereof rigid in the bundle discharging direction during discharge of the bundle into said second accommodating means.

2. A copy sheet stack apparatus as claimed in claim 1, wherein said curl means includes a guide member for guiding the bundle of the sheets, and a protruding member disposed on the guide member and extending in the bundle discharging direction.

3. A copy sheet stack apparatus as claimed in claim 1, wherein said first accommodating means accommodates the bundle of the sheets in a condition wherein each sheet stands slightly inclined to a vertical direction.

4. A copy sheet stack apparatus as claimed in claim 3, wherein said fall means includes a movable member disposed in said first accommodating means, the movable member regulating a lower end of each copy sheet to hold each sheet at a position where the movable member enters an inside of said first accommodating means, and the movable member causing the held sheet to fall at a position where the movable member exits the inside of said first accommodating means.

5. A copy sheet stack apparatus for stacking copy sheets discharged from an image-forming device and binding them, comprising:

copy sheet holding means for holding the copy sheets discharged from the image-forming device, said holding means having a copy sheet position regulating member for regulating a position of a lower end of each sheet to hold the sheet thereon, said regulating member being capable of moving between a first position wherein the regulating member contacts with and holds the sheet and a second position wherein the regulating member withdraws from contact with the sheet, binding means for binding a bundle of the sheets held by said copy sheet holding means, moving means for moving said regulating member from said first position to said second position, and a projecting member extending from said second position towards said first position to intersect the regulating member when said regulating member moves from said first position to said second position such that said projecting member contacts a surface of the sheet at least when said regulating member is in said second position causing the sheets to fall from said regulating member.

6. A copy sheet stack apparatus as claimed in claim 5, further comprising accommodating means for receiving and accommodating the bundle of the sheets bound by said binding means and fallen from said holding means.

7. A copy sheet stack apparatus as claimed in claim 5, wherein said holding means further includes a guide plate for contacting with an upper surface of the sheet and guiding the sheet, said regulating member being formed in a plate-like configuration such that one end of the regulating member is held rotatably by the guide plate and the other end of the regulating member is bent to hold the sheet.

8. A copy sheet stack apparatus as claimed in claim 7, wherein the regulating member includes plural openings extending vertically therethrough, each of said projecting members contacting the surface of the sheet through one of said plural openings.

9. A copy sheet stack apparatus for stacking copy sheets discharged from an image-forming device and binding them, comprising:

a copy sheet accommodating tray for holding the sheets discharged from the image-forming device, the tray including a base having a cutout extending from a lower end thereof to an upper end thereof, a plate member disposed in said cutout and capable of swinging between a first position and a second position, said plate member closing a bottom of said tray at said first position and opening the bottom thereof at said second position, binding means for binding the sheets accommodated into said tray, and means for swinging said plate member from said first position to said second position to allow the sheets bound by said binding means to fall from said tray.

10. A copy sheet stack apparatus as claimed in claim 9, further including accommodating means for receiving and accommodating a bundle of the sheets bound by said binding means and fallen from said tray.

11. A copy sheet stack apparatus as claimed in claim 9, wherein said plate member has an arm portion which in said first position is located in generally the same plane as said base, and a projecting portion disposed at a distal end of said arm portion to define the bottom of said tray.

12. A copy sheet stack apparatus in which after plural copy sheets discharged from an image-forming device are bound to form a bundle, the bundle of the sheets are stacked into a bucket, the apparatus comprising guide means for guiding the sheets into the bucket while the sheets fall by their own weight, said bucket having a front wall to contact each sheet at its front end as it enters said bucket, an upper end of the front wall thereof being disposed below a copy sheet discharging end of said guide means at least when a predetermined number of bundles are accommodated in said bucket, so that after the predetermined number of bundles of the sheets are accommodated in said bucket, the following bundle of the sheets passes over the bundles of the sheets accommodated in said bucket to an outside of said bucket, at least a front end portion of said bucket being capable of moving vertically and being urged upwardly by a bias force of a spring, so that said bucket is forced downwardly by the weight of bundles against the bias force of said spring as the bundles of the sheets are accommodated in the bucket, such that when said predetermined number of the bundles of the sheets are accommodated in the bucket the upper end of the front wall of the bucket is positioned below the copy sheet discharging end of the guide means.

* * * * *